United States Patent [19]

Voege

[11] 4,191,237

[45] Mar. 4, 1980

[54] GARAGE DOOR OPERATOR

[76] Inventor: Clayton B. Voege, 1418 Alimingo Dr., Indianapolis, Ind. 46260

[21] Appl. No.: 846,414

[22] Filed: Oct. 28, 1977

[51] Int. Cl.[2] ..... E05F 15/16

[52] U.S. Cl. ..... 160/188; 160/189; 160/193

[58] Field of Search ..... 160/188, 189, 191, 193, 160/321; 74/625; 248/16; 403/223, 287, 297, 371, 374

[56] References Cited

U.S. PATENT DOCUMENTS

| | | | |
|---|---|---|---|
| 967,856 | 8/1910 | Tappin | 160/193 |
| 1,458,894 | 6/1923 | Schwarz | 403/223 |
| 1,662,715 | 3/1928 | Morrow | 403/374 |
| 1,724,995 | 8/1929 | Dautrick | 160/191 |
| 1,827,433 | 10/1931 | Kendall | 160/189 |
| 2,070,058 | 2/1937 | McCloud | 160/188 |
| 2,099,191 | 11/1937 | Blogett | 160/189 |
| 2,882,044 | 4/1959 | Ginte | 160/189 |
| 3,285,634 | 11/1966 | Boyar | 403/287 |
| 3,364,974 | 1/1968 | Wiegand | 160/188 |
| 3,921,761 | 11/1975 | Votroubek et al. | 160/191 |

FOREIGN PATENT DOCUMENTS

| | | | |
|---|---|---|---|
| 475597 | 7/1931 | Canada | 160/189 |

*Primary Examiner*—Peter M. Caun
*Attorney, Agent, or Firm*—Jenkins, Coffey, Hyland, Badger & Conard

[57] ABSTRACT

Garage door opener for simple installation and to fully actuate various counterbalanced doors of different makes with minimum mechanism, and to be packaged and sold as a compact kit. The opener is built around a short main drive shaft adapted to be coupled coaxially to the end of the door counterbalance shaft. The drive shaft is journalled in two frame side members and therebetween carries a worm gear and two friction drive disks spring-pressed against the gear to transmit limited drive torque therefrom to the shaft. The gear is driven by a worm on the shaft of a motor on a carrier which is slidable on the frame. A manual cam moves the carrier between a worm-engaged position for drive and a worm-disengaged position to release the door for manual operation. A threaded extension of the main shaft carries a pair of traveling nuts which actuate switches to limit door travel both directions. In one modification, the assembly is mounted on studs on a mounting plate and adjusted thereto to bring the drive shaft coaxial with the counterbalance shaft, and the two shafts are coupled. In a second modification, the assembly is cantilevered by its drive shaft on the counterbalance shaft and is stabilized in coaxial relation therewith by a torque-reaction bracket. Such bracket may include a torque-limiting switch operable to reverse the drive in response to excess torque. For most installations, a down-drive cable is added to the counter-balance mechanism and connected to positively move the door from open to closed position in response to down-drive rotation of the counterbalance shaft.

29 Claims, 21 Drawing Figures

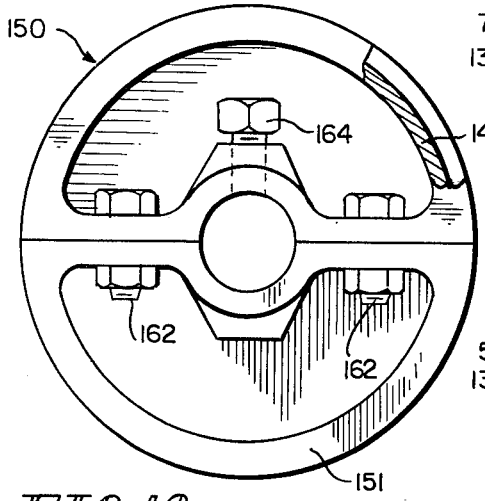
FIG. 12
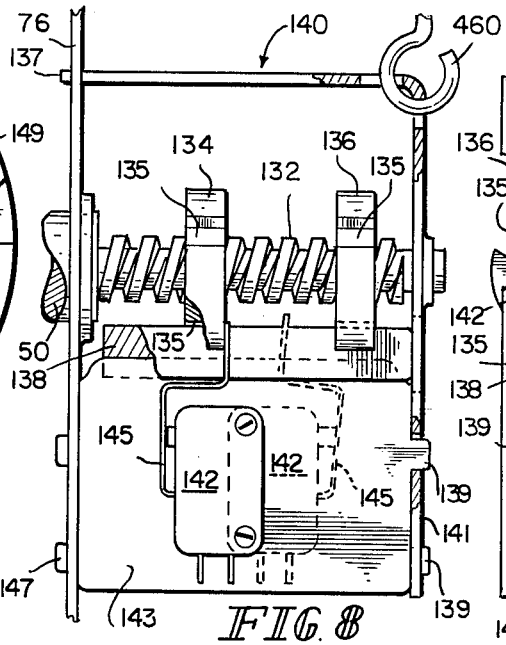
FIG. 8
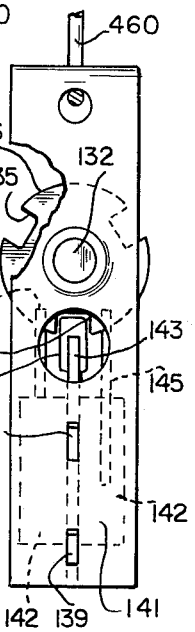
FIG. 9
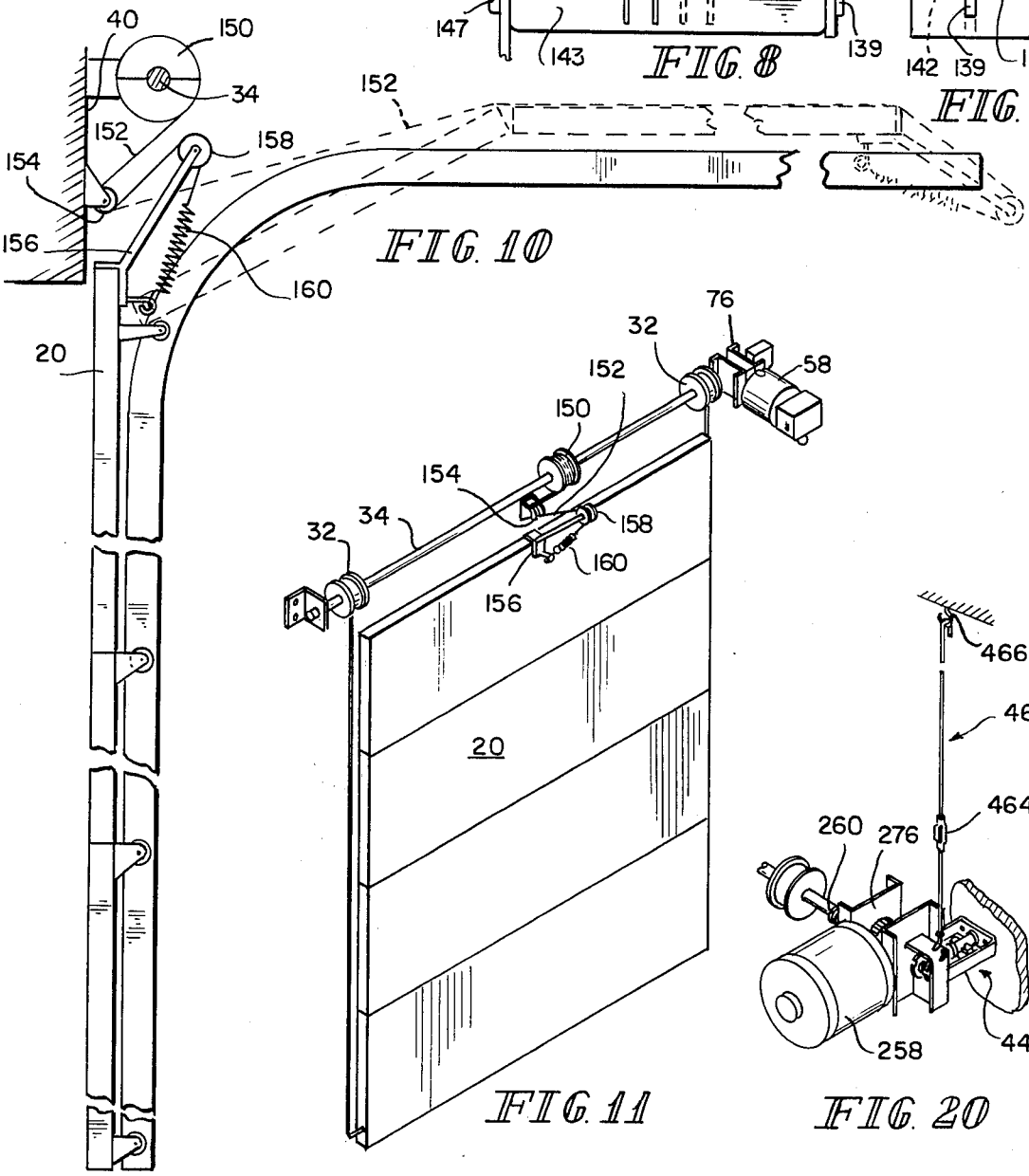
FIG. 10
FIG. 11
FIG. 20

GARAGE DOOR OPERATOR

This invention relates to an operating mechanism for counterbalanced garage doors, adapted to open and close such garage doors in response to a radio or other control signal.

It is an object of the invention to provide an improved garage door operator which will be simple to install and composed of simple, compact, and minimum mechanism so as to be packaged and sold in a compact kit, but which will be adapted for connection to door counterbalance mechanisms of various different makes and fully effective to operate the same.

In accordance with the invention, the operator is built around a short drive shaft adapted to be connected coaxially to the end of the door counterbalance shaft. The drive shaft is journalled in a frame and carries a worm gear which drives the shaft through a torque-limiting clutch. A worm for driving the gear is mounted on the shaft of a motor which is mounted on a movable carrier, movable by a manual cam between a gear-engaged driving position and a gear-disengaged release position which permits the door to be operated manually. An extension of the drive shaft carries actuating means, such as one or more traveling nuts, which actuate stop switch mechanism. In one modification, the assembly is mounted on a mounting plate by adjustment means which provide for aligning the drive shaft with the end of the counterbalance shaft to permit the two shafts to be connected by a coupling. In a second modification, the assembly is mounted by its drive shaft directly on and coaxial with the counterbalance shaft and the assembly is stabilized against rotation by a torque-reaction bracket extending between the frame and a fixed portion of the door frame structure. The torque-reaction bracket may be arranged to actuate a torque-responsive reversing switch to reverse door drive if excess torque occurs. Supplemental support for the cantilevered assembly may be provided by a hanger at its outer end.

Motor control mechanism and a light bulb are desirably mounted on or with the motor, and connected by a flexible cable to the stop switch mechanism. A conventional radio control mechanism is suitably mounted on or adjacent the operator control box and connected to actuate the operator in response to a radio signal.

Conventional counterbalance mechanisms for garage doors operate to apply lifting force to the door through one or more lift cables, and closing movement of the door is effected by manual or other force applied to the door so that the lift cables remain in tension between the door and the drums on which they are wound, in response to the counter-balancing torque applied to the drum shaft. Such counter-balancing mechanisms are not adapted to drive the door in a closing direction in response to driven rotation of the counterbalance shaft. Accordingly, in accordance with the present invention, a down-drive cable is connected between the door and a drum on the drum shaft. In some cases, it is feasible to wind such cable on the same drum with a door-lifting cable, and to pay out one cable as the other is wound on the drum, and vice versa. However, for more universal application, I preferably provide a split drum adapted to be mounted on the counterbalance shaft intermediate its ends, preferably at its center. The down-drive cable is connected from such drum to the door by way of a fixed pulley mounted on a header above the door, and thence to a traveling pulley at the end of a reach bracket mounted at the top of the door in a position such that the reach-bracket pulley is above the fixed pulley when the door is in lowered position so that the cable will always exert a downward force on the door throughout its entire range of operation.

The door-operating mechanism provided by the present invention is fully effective to operage garage doors through both opening and closing movements by driving the counter-balance shaft of any of various counterbalance mechanisms of different makes. It does so with simple and a minimum amount of mechanism which requires no extended shafts or tracks so that it is adapted to be packaged and sold as a compact kit. It is thus suitable for sale as an over-the-counter item which can be easily carried home and installed by the purchaser.

The accompanying drawings illustrate the invention and show embodiments exemplifying the best mode of carrying out the invention as presently perceived. In such drawings:

FIG. 8 is a vertical section on an enlarged scale in the same plane as FIG. 7, showing the motor stop switch mechanism at the extended right end of the main drive shaft;

FIG. 9 is an end elevation of the switch mechanism of FIG. 8, with parts broken away;

FIG. 10 is a somewhat diagrammatic vertical section, similar to FIG. 1, but showing the door-lowering mechanism;

FIG. 11 is a diagrammatic perspective view of a door and its operating mechanism including the door-lowering mechanism of FIG. 10;

FIG. 12 is an end elevation of a split drum adapted to be used in the door-lowering mechanism of FIGS. 10 and 11;

FIG. 20 is a diagrammatic view showing a supplemental support for a cantilever mounted operator.

Figures 1, 2, 3, 4:
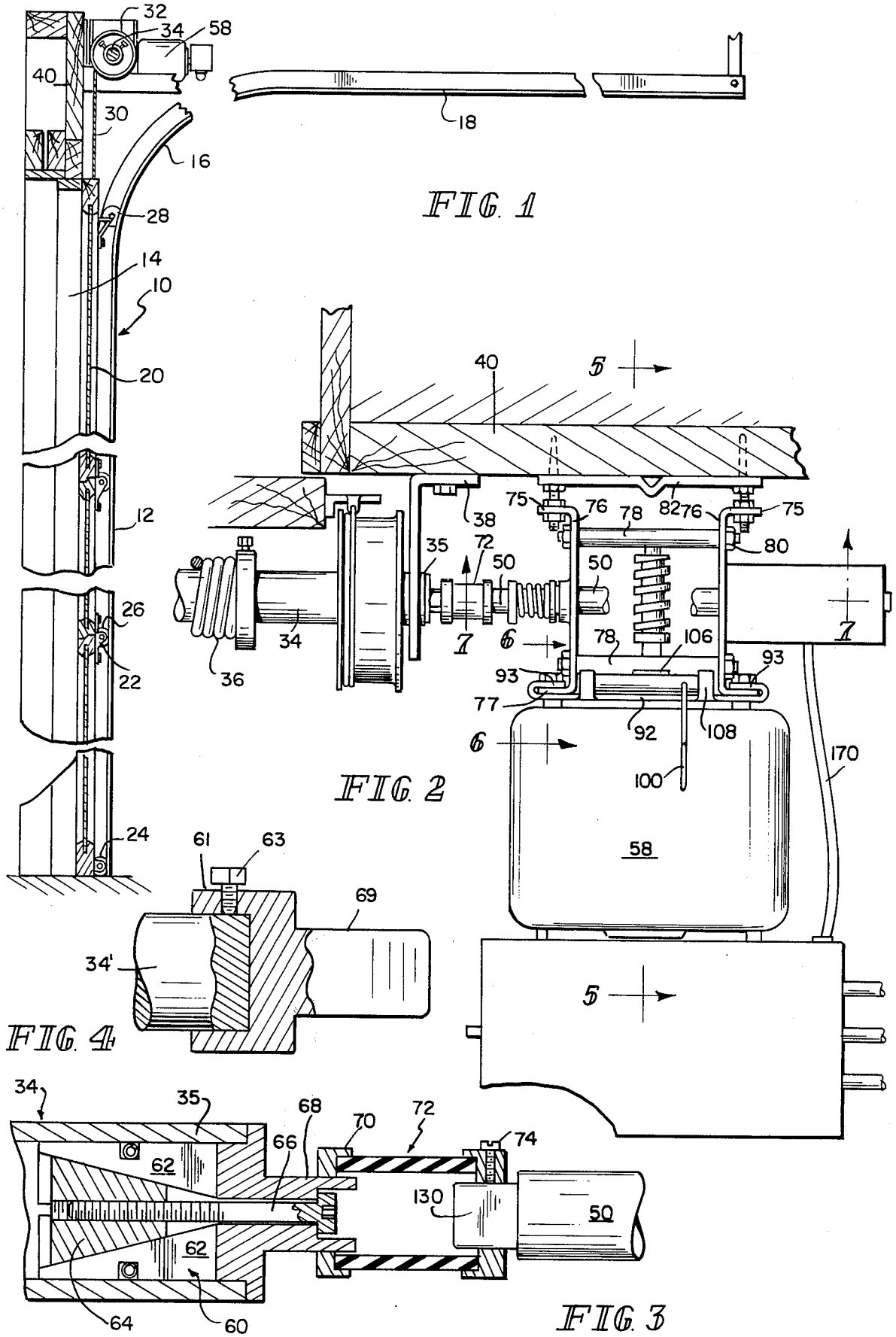
FIG. 1 is a vertical section of a garage door counterbalancing and operating mechanism in accordance with the invention, with such mechanism shown in larger than normal relation to the door and counterbalance apparatus for clarity.
FIG. 2 is a plan view of the operating mechanism shown in FIG. 1.
FIG. 3 is an axial section of a shaft coupling adapted for connecting the operating mechanism to a hollow counterbalance drum shaft.
FIG. 4 is an axial section of a coupling element adapted to connect the operating mechanism to a solid counterbalance drum shaft.

The garage door apparatus shown in FIG. 1 exemplifies the general type of such apparatus to which this invention relates. A track 10 is mounted at each side of the door, consisting of a channel of generally J-shaped cross section, extending in a vertical stretch 12 supported by the door side frame 14, merging at its upper end into a rearwardly curved section 16, which leads to a generally horizontal section 18. A sectional door 20 is mounted in the track to close against the door frame and consists of a series of horizontally extending sections, hinged together by hinges 22. The door is mounted in the track 10 by rollers, including lower rollers 24 carried by brackets at the lower edge of the door, rollers 26 carried on the hinge pins of the hinges 22, and upper rollers 28 on brackets adjacent the upper edge of the door. The door is counterbalanced by a pair of lift cables 30 running from anchor points at the bottom of the door upward along the sides of the door to drums 32 mounted on a counterbalance drum shaft 34. Such shaft is biased to rotate in a direction to apply counterbalancing lift force to the door, as by means of a coil spring 36 surrounding the shaft, as indicated in FIG. 2. The drum shaft is mounted for rotation in a pair of brackets 38 mounted on a header 40 extending across above the door frame. This arrangement leaves an end 35 of the drum shaft 34 projecting free beyond the mounting bracket 38. The garage door operating mechanism of the present invention is adapted to be mounted with its main shaft coupled to the projecting end 35 of the drum shaft so as to actuate the drum shaft 34 and thereby operate the door.

The door operating mechanism shown in FIGS. 1–8 comprises a drive shaft 50 which carries a worm gear 52 driven by a worm 54 on the shaft 56 of a motor 58. This basic mechanism is controlled by control means described below and is mounted with its drive shaft 50 connected in coaxial driving relationship with the end 35 of the drum shaft 34.

A coupling for connecting the drive shaft 50 to the drum shaft 34 when such drum shaft is a hollow shaft is shown in FIG. 3. Such coupling 34 comprises an expandable plug 60 adapted to be inserted in the end 35 of the drum shaft 34, and having expandable sections 62 which can be expanded into gripping engagement with that shaft by means of a wedge 64 drawn inward by a bolt 66. The outer end portion 68 of the plug is of square or other non-circular section and is telescopically received within one end plate 70 of a flexible coupling 72, the other end plate of which has a square or other non-circular section telescopically received over the correspondingly shaped end portion of the drive shaft 50. The coupling is a unitary element and is desirably fixed to one of the shafts, as by a set screw 74, and is slidably received on the other shaft so as to allow for variation in the spacing between the two shaft ends.

An alternative coupling for use with a solid drum shaft 34′ is shown in FIG. 4. This comprises a collar 61 received over the end of the drum shaft and fixed thereto by a set screw 63. The coupling includes a projecting end portion 69 of square or other suitable shape to be non-rotatably received within the end member 70 of the coupling 72.

Figure 5:
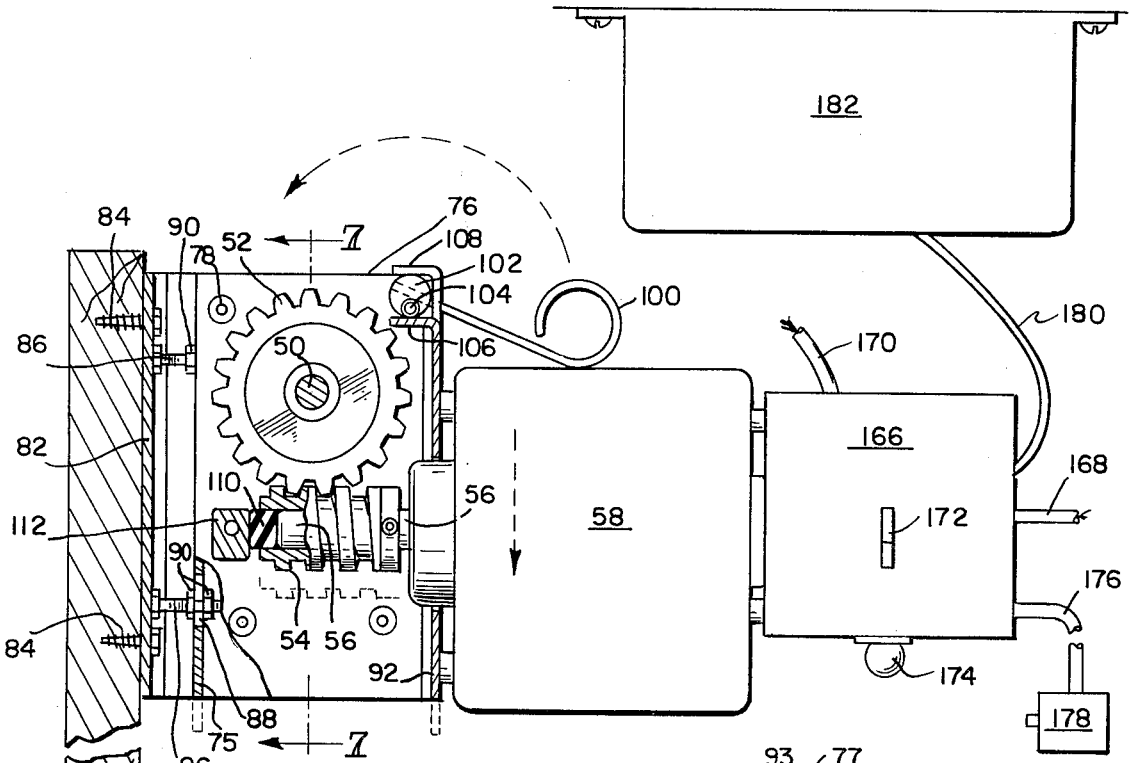
FIG. 5 is a vertical section, on the line 5—5 of FIG. 2.
Figure 6:
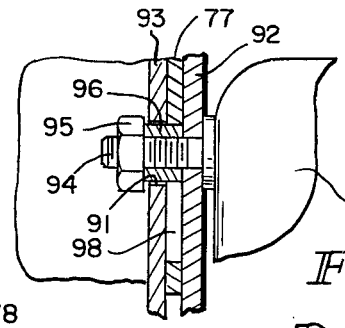
FIG. 6 is an enlarged fragmental section on the line 6—6 of FIG. 2.
Figure 7:
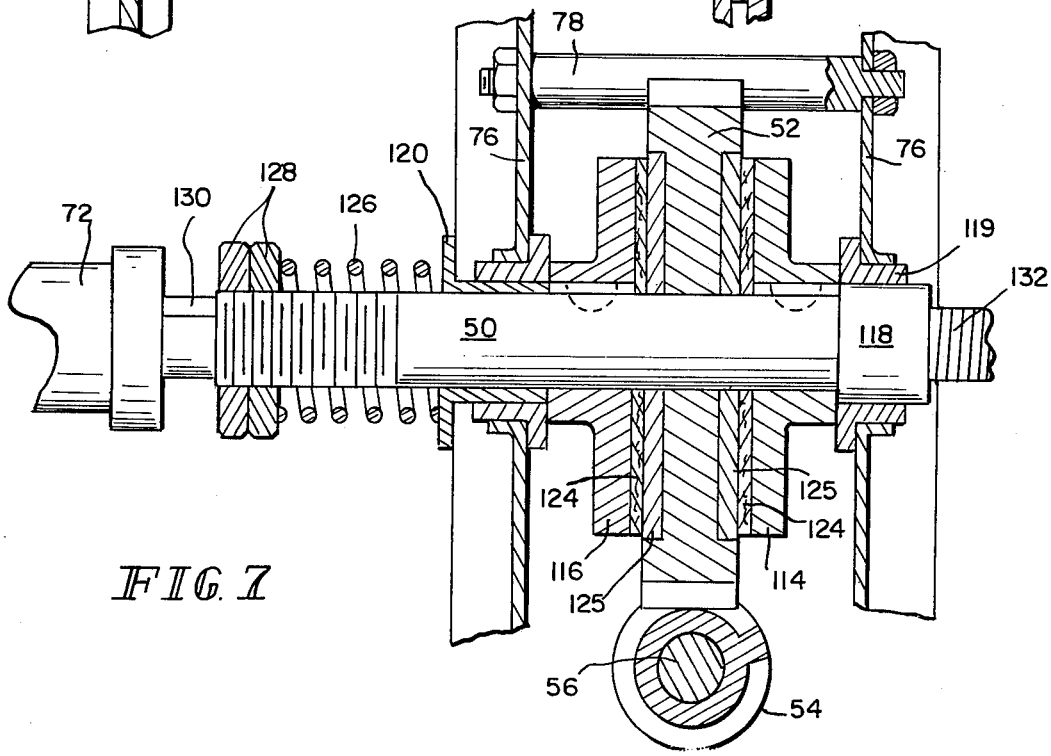
FIG. 7 is a vertical section taken on the lines 7—7 of FIGS. 2 and 5.

As shown in FIGS. 2, 5, and 7, the drive shaft 50 is mounted in a frame comprising a pair of channel-shaped side members 76, held in spaced relation by spacers 78 having threaded ends 80. The flanges 75 of the channel members 76, at one side of the frame, are used to mount the frame on a mounting plate 82. As shown in FIGS. 2 and 5, the mounting plate 82 is adapted to be secured flat against the header 40, as by lag bolts 84, and carries a pair of threaded mounting studs 86 at each side, in position to be received in slots 88 in the flanges 75 of the frame. The frame is adjustable on the studs, toward and away from the mounting plate, by means of pairs of nuts 90 which clamp the flanges 75 between them. The frame is also adjustable vertically by varying the positions of the studs 86 in the slots 88 of the mounting flanges.

At the opposite side of the frame, the flanges 77 are used to support a motor carrier plate 92. Such plate has in-turned edge portions 93 which with the plate 92 define inward-open channels forming a slideway to snugly receive the outward-extending flanges 77. The web of the plate 92 contains bolt holes to receive the threaded ends of the motor frame bolts 94. Such bolts carry spacers 96 which lie in vertical slots 98 in the flanges 77 and extend through enlarge holes 91 in the overlying edge portions 93 of the motor carrier plate. Nuts 95 on the bolts camp the spacers 96 against the carrier plate 92 so as to secure the motor to that plate, but are slightly longer than the thickness of the flanges 77 and inturned portions 93 so that the nuts 95 do not tightly clamp the flanges 77 or inturned portions 93. The arrangement provides a slidable mounting for the motor carrier plate 92 which allows the plate to move vertically the length of the slots 98. Such vertical movement will carry the worm 54 between a position of engagement with the worm wheel 52 as shown in full lines in FIG. 5 and a lowered position in which the worm 54 is disengaged from worm wheel 52, as shown in dotted lines, so as to disengage the motor drive for the door and permit the door to be operated manually.

A manual actuating lever 100 is provided for manually moving the motor carrier plate between such two positions. Such handle is connected to an elongated barrel cam 102, rotatable on an eccentric pin 104 extending through one pair of spacer bolt holes in the frame side members 76. Such barrel cam 102 is engaged from below by a central inward bent tongue 106 on the motor carrier plate 92, and is engaged from above by a pair of inward bent fingers 108 at the top outer edges of the motor carrier plate 92. As shown in FIG. 5, the handle 100 and cam 102 are in a position in which the cam holds the motor carrier plate in its raised worm-engaging position. By rotating the handle 100 and cam 102 through 180° counterclockwise, the motor carrier plate 92 will be lowered to a position in which the worm and worm wheel are disengaged, as shown in dotted lines in FIG. 5.

A forward thrust bearing for the worm 54 may be provided as shown in FIG. 5. The motor shaft 56 is made to terminate short of the end of the worm 54, so as to define a cylindrical cavity for the reception of a thrust bearing button 110 which is inserted in the projecting end of the worm 54 against the end of the shaft 56. The outer end of such button bearing 110 bears against a cross bar 112 mounted between the two side plates 76, so as to make forward thrust of the shaft 56 when the worm 54 is rotating in a direction to exert thrust in such forward direction. Thrust in the opposite direction may be taken by bearins within the motor.

Drive from the motor 58 and the worm gearing 52–54 is transmitted to the drive shaft 50 through a frictional drive as shown in FIG. 7. As there shown, the worm wheel 52 is rotatably mounted on the shaft 50 between a pair of frictional clutch disks 114 and 116. The clutch disk 114, at the right in FIG. 7, is keyed to the shaft 50 and bears against a collar 118 formed or fixed on the shaft 50, and also bears against a flanged bearing sleeve 119 by which the collar 118 is rotatably mounted in the side member 76 of the frame. The opposite clutch disk 116 is keyed to the shaft 50 and is engaged at its outer end by a pressure sleeve 120 which is slidable on the shaft 50 and received within a flanged bearing sleeve 122 in the adjacent side plate 76 of the frame. The two friction disks are lined with friction liners 124 which bear against steel wear plates 125 in the sides of the worm wheel 52. The slidable sleeve 120 is urged inward against the movable friction disk 116 by a pressure spring 126, which reacts against a pair of nuts 128 threaded on an end portion of the shaft 50. Beyond that threaded portion, the shaft has a non-circular section 130 for engagement in the coupling 72 shown in FIG. 3. The thrust produced by the spring 126 on the slidable sleeve 120 forces the clutch plate 116 toward the clutch plate 114 so that the clutch plates frictionally engage the worm wheel 52 and transmit driving torque from that wheel to the drive shaft 50, but allow the drive to slip in the event the door strikes some obstruction.

For purposes of stopping the door in its open and closed positions, the opposite end of the drive shaft 50 is arranged to actuate control mechanism which de-energizes the motor 58 when the door reaches a stop position. As shown in FIGS. 7 and 8, the drive shaft 50 includes a reduced-diameter threaded portion 132 at its end, to the right in those Figs. Such threaded end portion 132 carries a pair of threaded travel nuts 134 and 136. These are provided with a series of peripheral notches 135 and are held from rotation in adjusted positions by engagement of selected ones of such notches 135 with a stop bar 138. This control mechanism is desirably enclosed in an L-shaped housing 140 having a top horizontal leg and a vertical side leg 141. The top leg carries a stud 137 which is engaged through an opening in the frame side wall 76 and riveted thereto. The side leg is engaged over studs 139 on a mounting plate 143 mounted by studs 147 on the frame side plate 76. The stop bar is an inverted channel member, as of plastic, which is mounted endwise through a hole in the side cover leg 141 and straddles the top edge of the mounting plate 143, in engagement with notches 135 of the nuts. The plate 143 carries two switches 142 on its opposite sides, and each switch has an actuating lever 145 which stands between the two travel nuts 134 and 136. Rotation of the main shaft 50 and its threaded extension 132 will cause the travel nuts 134 and 136 to travel together lengthwise of that threaded extension 132 until one of the nuts strikes the actuating lever 145 of the adjacent switch 142 to throw that switch, and thereby interrupt the motor circuit and thereby stop the operation. Upon re-energization, the motor will rotate in the opposite direction to drive the door in the opposite direction. The threaded shaft extension 132 of the drive shaft 50 will then drive the travel nuts 134 and 136 in the opposite direction until the switch lever 145 of the other switch is engaged and that switch actuated to interrupt the reverse drive.

The housing 140 may also serve to connect the assembly to a supplemental supporting hanger 462 shown in FIGS. 8 and 20. As shown in FIG. 20, this is a stay or hanger rod containing an adjustable turnbuckle 464, and is to be fastened to an anchor in the ceiling or other fixed support.

The mechanism so far described is adapted to operate the door from a closed position to an open position, by rotating the drum shaft 34 in a direction to wind the lift cables 30 onto the drums 32 carried by that shaft. But reverse rotation of the drum shaft may not be reliably effective to close the door, especially when the upper sections 18 of the track 10 are substantially horizontal so that there is little gravitational pull tending to move the door from its fully open toward its closed position. Accordingly, the mechanism shown in FIGS. 10–12 is provided to drive the door in a closing direction. A down drive cable drum 150 is mounted on the drum shaft 34 at a convenient location along the length of that shaft. A down drive cable 152 is wound on the drum 150 and extends therefrom to a fixed pulley 154 mounted on the header 40 in a position close above the top of the door 20 but where it will not interfere with the opening movement of the door. A reach bracket 156 is mounted on the door and carries a reach pulley 158 in a position above the level of the fixed pulley 154. The down drive cable 152 extends from the fixed pulley 154 upward to the reach pulley 158 and thence downward to a tension spring 160 anchored at the bottom of the reach bracket so as to maintain tension on the down drive cable.

As indicated in FIG. 11, the down drive pulley 150 is desirably mounted at or adjacent the center of the drum shaft 34 and the center of the door 20, but can be mounted at any convenient point intermediate the width of the door. To permit that down-drive drum 150 to be mounted intermediate the length of the drum shaft 34 without disassembling the other mechanism, it is desirably made as a split drum. As shown in FIG. 12, such drum 150 comprises two semi-circular halves 149 and 151 separable on a diametric plane, and bolted together with bolts 162. The drum is fixed to the shaft 34 by a set screw 164.

As shown in FIG. 10, when the door 20 is in closed position, the reach pulley 158 is located above the fixed pulley 154, and the down drive cable 152 extends downward from that reach pulley to the fixed pulley. Accordingly, as the door approaches closed position in its closing movements, the down drive cable will always extend in a direction to exert a downward force on the door to carry it to its fully closed position. When the door is fully opened, as shown in dotted lines in FIG. 10, the down drive pulley 152 extends across the top or outer face of the door from the reach pulley 158 to the fixed pulley 154. In all positions of the door between that fully opened position and the fully closed position of the door, the down drive cable 152 is in a position to exert a closing force on the open door.

The electric circuits for controlling the door may be in accordance with conventional practice. For compactness, and simplicity of mounting, a motor control housing 166 may be mounted on the outer end of the motor 58. Such motor control is provided with a power lead 168 and is connected by flexible cable 170 to the limit switches 142 shown in FIG. 8. It desirably also includes an on/off switch 172 and a socket for a light bulb 174. For manual operation of the control circuits, the control housing may be connected by a cable 176 to a manual push button 178. For radio control, it is connected by a cable 180 to a radio control unit 182 adapted to be actuated by a radio signal from a remote shortwave control device.

The door operating mechanism is adapted to be packaged and sold as a compact kit, conveniently in three units. The first unit will include the mounting plate 82, and the motor-transmission assembly consisting of the frame 76 with the motor 58, the control housing 166, and the other parts mounted on that frame. Such unit will also include one or both of the shaft coupling devices 60 and 61 shown in FIGS. 3 and 4 together with a flexible coupling 72. Such unit will also include a split down-drive pulley 150 and a reach bracket 156 and a pulley 154. This unit will thus provide as a self-contained and complete unit a motor and drive mechanism for operating the door both in opening and closing movements, but will not include electrical apparatus for actuating the motor control mechanism. A second unit will include a manual pushbutton 178 and its necessary accessories for connecting it to the motor control housing 166. A third kit unit will comprise the radio control 182 and a remote shortwave sending unit to actuate that radio control mechanism, together with the necessary accessories to mount the radio control and connect it to the motor control housing 166.

Installation of the door operating mechanism of FIGS. 2–12 is relatively simple. The mounting plate 82 will first be mounted on the header or other structure of the garage providing a mounting surface substantially coplanar with the surface on which the supporting bracket 38 for the drum shaft 34 is mounted. The mounting plate 82 will need to be mounted in a position relative to the end 35 of the drum shaft such that the center rib 83 on that mounting plate is close to a predetermined horizontal distance from the end 35 of the drum shaft. When the mounting plate 82 has been so mounted by its lag screws 84, the subassembly including the frame 76 will be mounted by its flanges 75 on the stud bolts 86 projecting from that mounting plate 82. Conveniently, the subassembly is first loosely mounted on those studs 86, and the nuts 90 on those studs are adjusted so as to adjust the frame toward or away from the mounting plate 82 to bring the shaft 50 into the vertical plane containing the drum shaft 34. The long studs 86 will provide a substantial adjustment for this purpose. The frame 76 is then raised or lowered on the studs 86 to bring the shaft 50 into alignment with the drum shaft 34, and the nuts 90 are tightened. A coupling element 60 or 61 will be mounted on the end of the drum shaft, depending upon whether the drum shaft is a hollow shaft 34 as shown in FIG. 3 or a solid shaft 34' as shown in FIG. 4. When the coupling element 60 or 61 has been fixed in or on the end of the drum shaft, a flexible coupling is installed to connect the squared end 68 or 69 of the coupling to the squared end 130 of the drive shaft 50.

The down drive mechanism is then installed. This involves installing the split drum 150 at a convenient point on the drum shaft 34, installing the reach bracket 156 on the door 20, installing the fixed pulley 154 on the header 40, and stringing the down drive cable 152 and its tension spring 160. The door operator is then ready to be connected to a source of power by the power cable 168, as by plugging a connector at its end into a suitable receptacle. Either or both of a manual pushbutton control unit 178 or a radio control unit 182 is installed, and the door operating mechanism is then ready for operation.

In operation, when the motor control mechanism in the housing 166 is actuated by one of the actuating units 178 or 182, it will energize the motor 58. If the door is closed as shown in FIG. 1, one of the stop switches 142 shown in FIG. 8 will be in a position to cause the motor 58 to rotate in a direction to raise and open the door. Such rotation will cause the worm 54 to drive the worm wheel 52 and this in turn will drive the drive shaft 50 in a direction to rotate the drum shaft 34 to cause the drums 32 to reel in the lift cables 30 and lift the door. As the drive shaft 50 rotates, its threaded extension 132 will also rotate in the travel nuts 134 and 136 held from rotation by the stop rod 138. This will cause those travel nuts to travel lengthwise of the threaded extension 132 until the trailing nut strikes the actuating lever 145 of the opposite stop switch 142 and actuates that switch. This will actuate the control mechanism to de-energize the motor 58 and the door operating drive will stop, and will also set the motor control mechanism to reverse the direction in which the motor will rotate in the next cycle of operation. Accordingly, if the door has been raised in the first cycle of operation, the next cycle of operation will cause the motor 58 to rotate in a reverse direction so as to drive the drum shaft 50 in an opposite or door-closing direction. As the drum shaft rotates in such opposite direction, the drums 32 will pay out the cables 30 to allow the door 20 to be lowered, and the split drum 150 will reel in the down drive cable 152, and thus cause that cable to pull the door from its raised to its closed position.

The modified garage door opener shown in FIGS. 13–16 provides a modified arrangement which is even more simple and expeditious than that of the operator shown in FIGS. 1–9. The operator shown in FIGS. 13–16 is similar to that described above and includes a motor 258 having a worm 254 on its shaft arranged to drive a worm wheel on a drive shaft 250 in the same manner as before. The motor is mounted on a frame comprising pair of side plates 276, in a manner identical with that described above. The frame members 276 have out-turned flanges 277 for mounting the motor, but at their opposite side have flanges 275 which are turned inward rather than outward as in FIG. 2, and such flanges serve only to stiffen the frame and are not used for purposes of mounting. The frame carriers a switch housing 240 identical with the housing 140 described above and containing similar motor control mechanism. The opposite end of the drive shaft 250 carries a clutch loading spring 236, as before, backed up by a pair of adjustable nuts 238. Beyond those nuts 238, the end 330 of the drive shaft is cylindrical and is provided with a cross hole for the reception of a mounting bolt 331.

This cylindrical end 330 of the main shaft 250 of the operator is used as the primary mounting means of the entire operator assembly, and the primary mounting is accomplished by coupling this shaft end in supported coaxial relation with the hollow drum shaft 234 of the door counterbalance mechanism. For this purpose, an expansible coupling unit 260 is inserted in the open end of the drum shaft 234. Such unit comprises a coupling member 261 and a collet member 263 arranged to be drawn together by a bolt 266. The two members have three angularly-spaced axial grooves with tapered bottoms, which receive three wedge bars 265. When the bolt 266 is tightened, the bars are expanded into firm engagement with the inside of the drum shaft 234 and hold the coupling coaxial therewith. The outer end of the coupling member 261 is counterbored to receive the end 330 of the operator drive shaft 250, with a close sliding fit, and the two are secured with a cross bolt 331.

Figure 15:
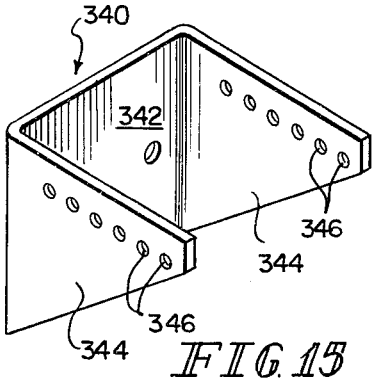
FIG. 15 is a perspective view of the mount-stabilizing bracket shown in FIG. 14.

This connection of the main drive shaft 250 of the door operating mechanism to the drum shaft of the door counterbalance mechanism will provide substantially full support for the entire operator assembly. Means is provided, however, to take the torque reaction of the operator as it drive the drum shaft 234. Such torque reaction may be taken by a torque bracket 340 as shown in FIG. 15, which also provides supplemental support for the operating assembly. Such torque bracket 340 is a generally U-shaped bracket having a rear wall 342 mounted against the header 40 of the door structure, and two forwardly bent side members 344 which lie against the outer faces of the side members 276 of the main frame. The two side members 344 are provided with a series of holes 346 for engagement over the ends of one of the tie bolts 280 by which the side plates 276 of the frame are held in spaced relation.

Figure 14:
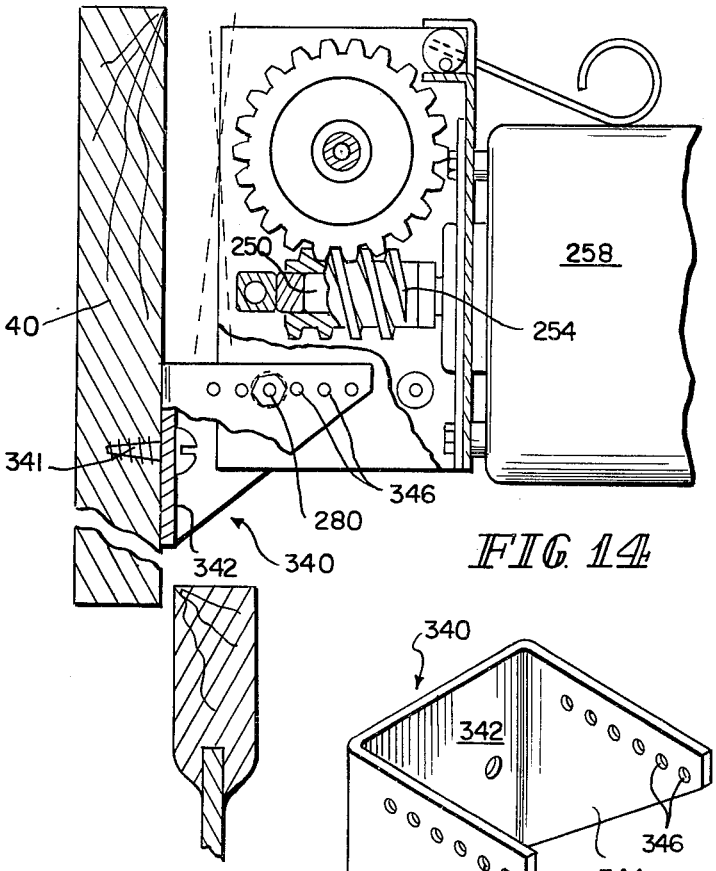
FIG. 14 is a side elevation similar to FIG. 5, taken on the line 14—14 of FIG. 13, with parts broken away, showing a mount-stabilizing bracket for the modified door operator of FIG. 13.

As shown in FIG. 14, when the operator assembly has been mounted on the drum shaft 234 by means of the coupling 260, the torque bracket 340 is then mounted against the header 40 as by screws 341, in a position such that one set of the holes 346 in the side members of that bracket are aligned with and received over the lower tie bolt 280 adjacent the opposite side of the frame from the motor 258. Since the operator assembly is not otherwise held against rotation about the axis of the main shaft 250 in the absence of such torque bracket 340, the operator assembly may be rotated in either direction about that axis to bring a set of such holes into alignment with the tie bolt. The bracket will then take the torque reaction, and may also provide supplemental support to hold the operator assembly with its drive shaft 250 on the axis of the drum shaft 234 which it drives.

Figure 13:
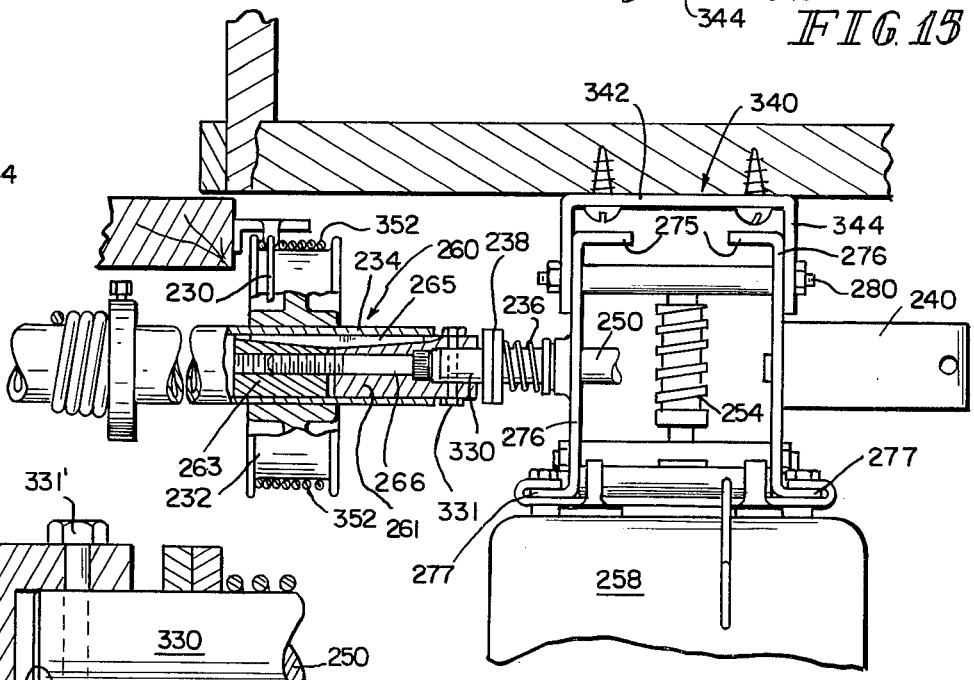
FIG. 13 is a plan view, similar to FIG. 2, but showing a modified door operator and mounting and a modified down-drive arrangement, in accordance with the invention.
Figure 16:
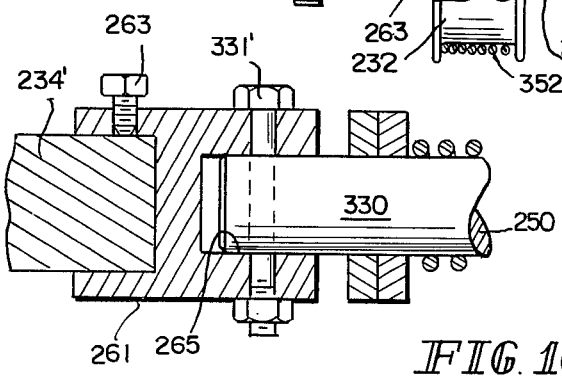
FIG. 16 is an axial section of a mounting unit for mounting the modification of FIGS. 13–15 on a solid counterbalance drum shaft.

In the event the drum shaft is a solid shaft 234' as shown in FIG. 16, instead of the hollow shaft 224 shown in FIG. 13, the modified coupler 260 shown in FIG. 16 may be used in place of the coupler 260 shown in FIG. 13. This includes a collar which fits over the end of the shaft 234' and is secured thereto by one or more set screws 263. Its opposite end is counterbored to provide a cylindrical socket 265 for the reception of the cylindrical end 330 of the drive shaft 250, and the coupling and shaft are secured together by a cross bolt 331' as before.

The operation of the garage door operator as shown in FIGS. 13–16 is the same as that of the operator shown in FIGS. 1–9.

Figure 17:
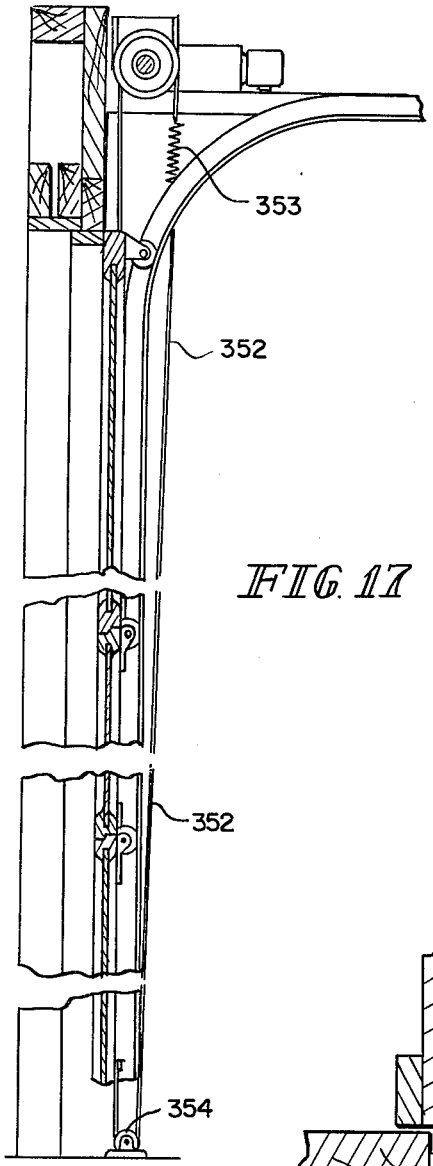
FIG. 17 is a vertical section of a door counterbalance and operating mechanism, which taken with FIG. 13, shows a down-drive cable wound on the same drum with a lift cable.

FIG. 13, taken with FIG. 17, also shows a modified down drive mechanism which may be used in suitable installations instead of the down drive mechanism shown in FIGS. 10–12. In the down drive mechanism of FIGS. 13 and 17, a down drive cable 352 is mounted on one or each of the cable drums 232 which carry the lift cables 230. As shown in FIG. 13, a down drive cable 352 is wound on the cable drum 232, beginning at the opposite end thereof from the lift cable 230, and the arrangement is such that as the lift cable 230 is wound onto the drum 232, the down drive cable is unwound off that drum, and vice versa. As shown in FIG. 17, the down drive cable 352 leaves the drum 232 at the opposite side thereof from the lift cable 230, and extends downward from the drum to a pulley 354 mounted in a bracket 355 secured to the floor of the garage at the bottom of the door opening. From the pulley 354, the down drive cable 352 extends upwards, and its end is secured to the door, as by means of the same bracket by which the lift cable 230 is attached. To maintain the cables taut and to provide for some variation in combined length as the door moves from its fully closed to its fully open position, the down drive cable 352 desirably includes a tension spring element 353, in a location such that it does not strike either the drum 232 or the pulley 354 during operation. While only a single down drive cable 352 has been shown and described, it will be obvious that down drive cables 352 may be mounted at both sides of the door and wound on both lift cable drums at the opposite ends of the drum shaft.

Operation of this down drive mechanism will be similar to that of FIGS. 10–12. As the drum shaft 234 is driven by the operating mechanism, which may be either that shown in FIGS. 1–9 or that shown in FIGS. 13–16, as the door is lifted from fully closed position, the lift cable 230 will wind onto the lift drum 232, and the down drive cable will simultaneously unwind from that lift drum. When the door is in fully open position, the lift drum will mostly contain life cable 230 and little down drive cable 232. When the mechanism is operated to close the door, the drum 232 will be rotated in the opposite direction, and this will pull on the down drive cable 352 so as to exert downward pull on the open door. This will pull the door toward closed position, and the down drive cable 352 will be wound onto the cable drum 232 while the lift cable 230 will be unwound from that drum.

Figure 18:
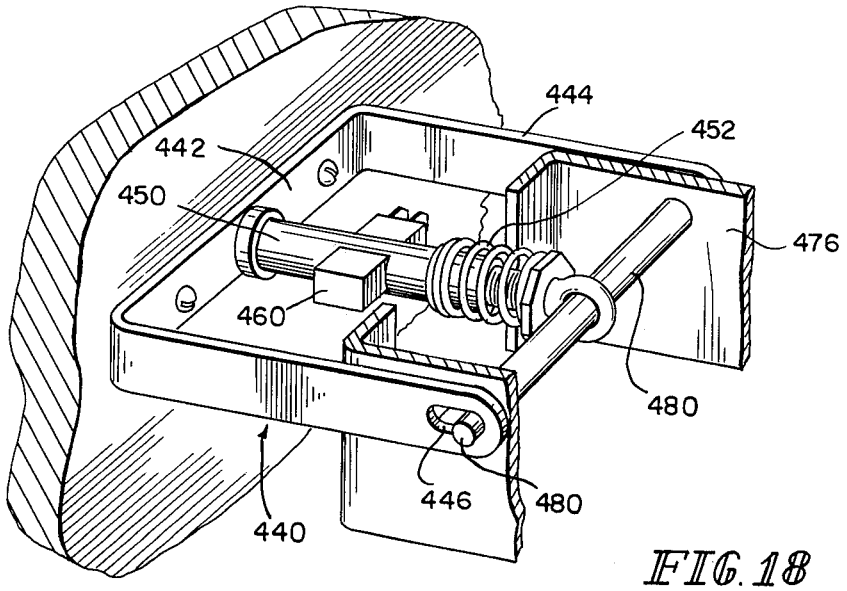
FIG. 18 is a perspective view showing a modified mount-stabilizing bracket combined with a torque-limiting switch mechanism.
Figure 19:
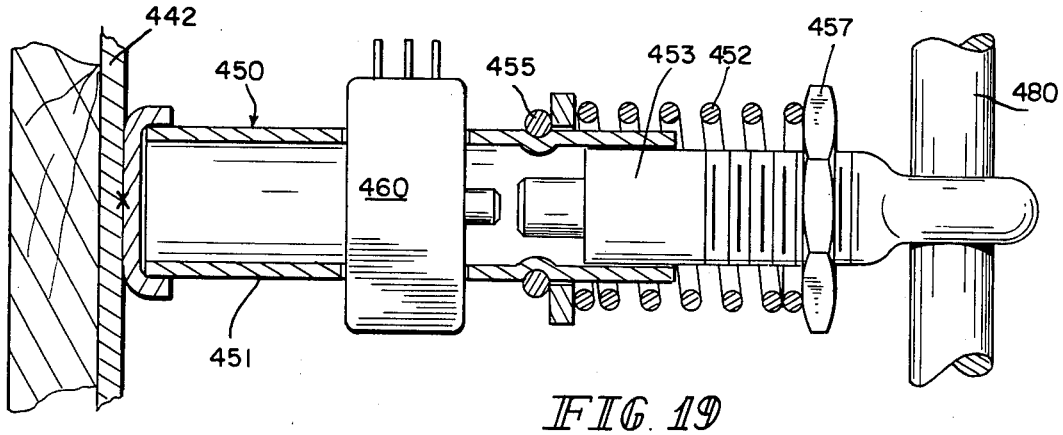
FIG. 19 is an axial section through the torque-limiting switch mechanism of FIG. 18.

Instead of using the rigid torque-reaction bracket 340 shown in FIGS. 13–15, a torque-reaction bracket as shown in FIGS. 18 and 19 may be used, which is responsive to excess torque and operative in response thereto to actuate a reversing switch to reverse the down drive and raise the door in the event the door strikes an obstruction. This is a safety feature, commonly employed in door operators, and the mechanism shown in FIGS. 18 and 19 provides for this feature in the door operating mechanism of the present invention.

The torque-reaction bracket 440 shown in FIG. 18 comprises a generally U-shaped bracket having a mounting base 442 and two side legs 444 each having a slotted opening 446 at its end. Such slotted opening are received over the projecting ends of one of the spacer bolts 480. A yieldable strut 450 is connected between the center of the spacer bolt 480 and the base 442 of the torque-reaction bracket, and is normally expanded by a compressionspring 452 so as to hold the ends of the spacer bolt 480 at the outer limit of their travel in the slots 446. During down drive of the door, the travel in the slots 446. During down drive of the door, the torque reaction will tend to rotate the frame 476 of the operation in a direction to compress the yieldable strut 450, against the force of the compression spring 452. If such torque reaction is excessive, such thrust will overcome the spring 452 and will compress the strut 450, and such compression will actuate a reversing switch 460 mounted in that strut. As shown in FIG. 19, the strut 450 comprises a main tubular portion 451 which telescopically receives a plunger 453. The compression spring 452 acts between a snap ring 455 mounted on the tube 451 and a nut 457 threaded onto the plunger 453. Adjustment of the nut will vary the force with which the spring resists the torque reaction, and thus vary the torque level at which the reversing switch will be actuated. The inner end of the plunger 453 crries a stud in position to actuate the reversing switch 460 when the plunger 453 is thrust into the tube 451.

The torque reaction bracket of FIGS. 18 and 19 will provide substantially no supplemental support for an operator assembly mounted to project in cantilever reaction from the end of the counterbalance shaft, and it is believed that such supplemental support may not be needed when the assembly is mounted by means of the coupling 260 shown in FIG. 13. Where such support is found desirable, it may be provided by a stay or hanger 462 connected at its lower end to the assembly at a point spaced axially from the coupling 260. The hanger is connected to the assembly by a swivel connection which will allow the assembly to rotate on the axis of the main shaft. While the swivel axis is most desirably coincident with the shaft axis, a small offset may be used, and as shown in FIGS. 8 and 20, the hanger 462 is hooked into an opening in the cover 140 of the switch mechanism, close to the axis of the main shaft 50. The hanger 462 includes a turnbuckle 464 to adjust its length, and is hooked to a fixed screweye 466 or the like in the ceiling of other overhead support so as to provide vertical lift support at the outer end of the assembly.

Figure 21:
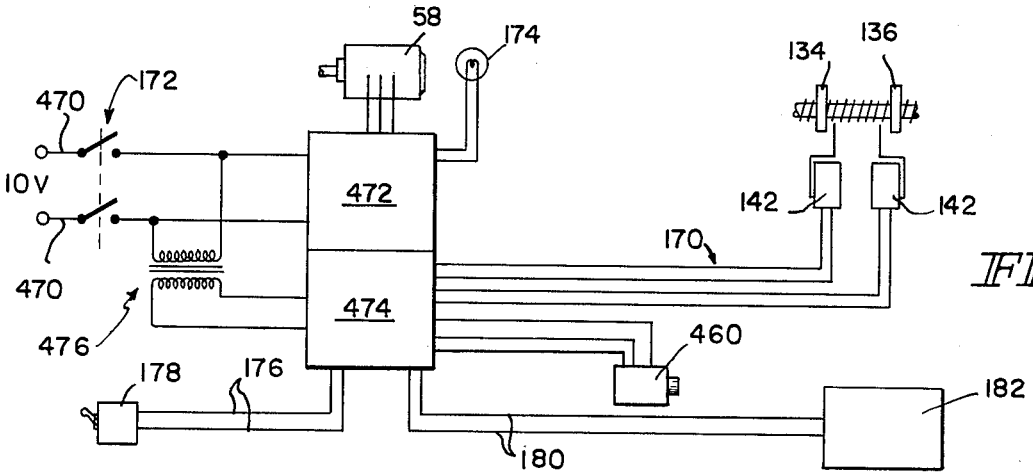
FIG. 21 is a wiring diagram.

In the schematic wiring diagram of FIG. 21, power is supplied through wires 470 of the on-off switch to the power section 472 of a relay. The relay is connected by a three-wire connection to the mtor 58 (or 258) and to the signal light 174. The relay includes a control section 474 which is energized through a transformer 476 connected to the main power leads. The control section of the relay is connected to a cable 170 to the stop switches 142 actuated by the traveling nuts 134 and 136. The control section is also connected by a three-wire connection to the reversing switch 460 shown in FIGS. 18 and 19. This electrical system is analogous to the systems used to energize and control conventional door operating mechanism. When the control section 474 of the relay receives an actuating signal either from the manual pushbutton 178 or the radio control unit 182, it will operate to energize the motor 58 to drive the door operating mechanisnm in a door-raising or door-closing direction, depending upon the condition of the stop switch 142 and the circuits controlled thereby in the relay mechanism. When the door is being operated, the light 174 will be energized, and will continue so until a predetermined time delay after the door operating cycle has been completed. In the event the door strikes an obstruction as it is being closed, and the mechanism includes a torque-responsive device as shown in FIGS. 18 and 19, the excess torque will collapse the strut 450 and actuate the reversing switch 460, and this will actuate the relay mechanism to reverse the direction of operation of the motor 58 and thus stop the door closing movement and initiate a door opening movement which will continue until the door is fully opened.

The invention of this application provides a garage door operator which is of especially compact and simple form and construction and is readily adapted to be sold as a kit for existing or otherwise self-contained garage door installations of the type including a counter-balanced drum shaft. The assembly is of such compact and self-containined characteristics that it is feasible to use the counterbalance shaft itself as its primary support. The motor drive is engaged and disengaged by the simple manual operation of rotating an eccentric cam between opposite dead center positins to engage and disengage the worm on the motor with and from the worm gear on the main shaft. The main shaft drive is protected by a torque-limiting clutch.The stop-control mechanism is actuated directly from the main shaft itself, and the timing between such control mechanism and the door remains constant in spite of any slippage from excess torque or any disengagement of the driving worm from the worm gear. The result is a unit of extremely simple construction and relatively low cost which is especially adapted for sale as a kit and for installation by the purchaser.

I claim:

1. A door operator unit adapted to be sold as such and to be mounted as a unit for actuating an overhead garage door which is counterbalanced by means including a drum shaft having a drum thereon for a lift cable attached to the door, comprising a unitary assembly including a frame having a main shaft journalled therein, a worm gear mounted on said shaft and drivingly connected thereto, a motor mounted on said frame, and a worm mounted on the shaft of such motor in driving relation with the worm gear on the main shaft, and means for mounting the unitary assembly with its main haft in coaxial driving relation with the drum shaft of the door counterbalance means, said mounting means including means for coupling the end of the main shaft of the operator unit is coaxial driving relation with the end of the drum shaft, and means for transmitting torque reactin from said frame to a fixed support.

2. A door operator as in claim 1 in which said mounting means includes a mounting plate adapted to be mounted on a fixed support, means for adjustably mounting said frame on said plate so as to position the main shaft in axial alignment with the drum shaft, and a coupling for connecting said shafts in driving relation.

3. A door operator as in claim 1 in which the means for coupling said main shaft in coaxial driving relation with the drum shaft is a supportive means which supports the main shaft on the drum shaft, such supportive means providing the primary mounting support for the unitary assembly so that such assembly is primarily supported by the drum shaft itself which it drives, reactive rotation of the assembly about the axis of the drum shaft being opposed by said torque reaction transmitting means.

4. A door operator as in claim 3 in which the unitary assembly is cantilevered from the end of the drum shaft.

5. A door operator as in claim 4 which includes means for providing supplemental lift support for the cantilevered assembly while permitting at least partial relative rotation of the assembly about the axis of the drum shaft.

6. A door operator as in claim 4 in which supplemental lift suport for the cantilevered unitary assembly is provided by the torque reaction transmitting means.

7. A door operator as in claim 1 in which said motor is mounted on a carrier movable on the frame between a gear-engaged position and a gear-disengaged position, the worm in the gear-disengaged position of the carrier being disengaged from the worm gear so as to allow manual operation of the door, and manually operable means for moving the carrier between such two positions.

8. A door operator as in claim 7 in which said frame comprises a pair of side plates fixed in spaced relation and having oppositely extending flanges in a plane tangential to the axis of said main shaft, and the carrier is slidably mounted on said flanges.

9. A door operator as in claim 8 in which said manually operable means comprises an eccentric cam on one of the frame and carrier, and a cam follower on the other of said elements, rotation of the cam being operative to move the carrier plate and motor between the gear-engaged and gear-disengaged positions thereof.

10. A door operator as in claim 1, further comprising a motor carrier movably mounted on the frame, the motor being mounted on the carrier, an eccentric cam mounted on one of said frame and carrier and cam follower means on the other of such elements, and manual means to rotate the cam between a gear-engaged position in which the worm is engaged with the worm wheel and a gear-disengaged position in which the worm is disengaged from the worm gear so as to allow the door to be operated manually.

11. A door operator as in claim 10 in which the frame includes means forming a slideway and the carrier is slidably mounted thereto, and the cam is rotatably mounted on one of said frame and carrier and is engaged on opposite sides by cam follower means on the other of such elements so that rotation of the cam positively moves the carrier in both directions between its two positions.

12. A door operator as in claim 11 in which the cam moves to dead center positions in which it positively holds the carrier in its two positions.

13. A door operator as in claim 1 with the addition of a down drive cable, a drum of the counterbalance drum shaft, a fixed pulley adjacent the top of the door, a reach bracket extending beyond the top of the door, the down-drive cable extending from the drum to the fixed pulley adjacent the top of the door and thence to an engagement point on the reach bracket, said engagement point being above the said fixed pulley when the door is closed.

14. A door operator as in claim 13 in which the down-drive drum includes a radially separable part which permits it to be added to the counterbalance drum shaft intermediate its ends.

15. A door operator as in claim 1 in which the counterbalance drum shaft is a hollow shaft and which includes a coupling having an expansible end for insertion in such hollow shaft and expansion to fix the same therein, and a connection end for connection to the main shaft of the door operator.

16. A door operator for actuating an overhead garage door which is counterbalanced by means including a drum shaft having a drum thereon for a lift cable attached to the door, comprising a frame having a main shaft journalled therein, and a worm gear mounted on said shaft and drivingly connected thereto, a motor mounted on said frame and a worm mounted on the shaft of such motor in driving relation with the worm gear on the main shaft, means for coupling the main shaft in coaxial driving relation with the drum shaft of the door counterbalance means, a mounting plate adapted to be mounted on a fixed support, means for adjustably mounting said frame on said plate so as to position the main shaft in axial alignment with the drum shaft, said mounting means comprising mounting studs on said mounting plate, said frame having flanges thereon through which said studs project, and means for securing the flanges in adjusted positions axially of the studs.

17. A door operator as in claim 16 with the addition that said flanges are formed with slots to receive the studs in different positions of adjustment along the slots, for adjusting the frame in translation relative to the studs, and said securing means is operative to secure the frame as so adjusted.

18. A door operator for actuating an overhead garage door which is counterbalanced by means including a drum shaft having a drum thereon for a lift cable attached to the door, comprising a frame having a main shaft journalled therein, a worm gear mounted on said shaft and drivingly connected thereto, a motor mounted on said frame, and a worm mounted on the shaft of such motor in driving relation with the worm gear on the main shaft, mounting means for mounting the main shaft coaxially to the drum shaft so as to drivingly interconnect such shafts and provide substantial support from the drum shaft for the main shaft and the operator assembly while permitting rotation of such assembly about the drum shaft axis, means forming a torque-reaction train to oppose such rotation, a yieldable element in the torque reaction train, and a reversing switch actuated in response to excess torque reaction through such train.

19. A door operator as in claim 18 in which said worm gear is rotatably mounted on the main shaft, and torque-limiting drive means between the shaft and gear, the torque-responsive reversing switch being set to reverse the motor under a torque load less than the torque load to which the torgue-limiting drive means limits the drive between the worm gear and shaft.

20. A door operator as in claim 7 with the addition of stop switch means for stopping the motor at the ends of opening and closing movements of the door, a threaded shaft extension on the main shaft, and one or more travelling nuts on said shaft extensions and held from rotation so that rotation of the shaft causes the nut to travel axially, said switch means having actuating means in position to be actuated by said nut or nuts, the nut or nuts being adjustable on the shaft to control the open and closed positions of the door, said shaft extension being rotatable with the main shaft independently of the engagement or disengagement of the worm with the worm gear.

21. A door operator as in claim 1 in which said worm gear is rotatably mounted on the main shaft, torque-limiting drive means between the shaft and gear, operative to cause the gear to drive the shaft under normal torque loading but to allow the gear to rotate on the shaft in the event of excess torque load therebetween, stop switch means for controlling the motor, and actuating means for such switch means driven in timed relation by said main shaft independently of said torque-limiting drive means whereby rotation of the worm gear on the shaft will not change the timed relation of the stop switch actuation to the actuation of the door by the main shaft, said stop switch actuating means comprising a threaded extension rotatable with the main shaft, and a pair of traveling nuts mounted on such extension and held from rotation so that rotation of the extension causes the nuts to travel axially, said stop switch means being actuated by said nuts to stop the door-opening and door-closing movements respectively of the operator, and said nuts are independently adjustable on the shaft so as to independently determine the open and closed positions of the door.

22. A door operator for actuating an overhead garage door which is counterbalanced by means including a drum shaft having a drum thereon for a lift cable attached to the door, comprising a frame formed of a pair of side plates and means to hold the plates in spaced relation, a main shaft journalled in said plates and a worm gear mounted on said shaft between the plates and drivingly connected to the shaft, said plates having oppositely extending flanges disposed in tangential relation to the axis of said shaft, a carrier slidably mounted on said flanges, a motor mounted on the carrier and having a shaft, a worm on said shaft for engagement with said worm gear, manually operable cam means acting between the frame and carrier for moving the carrier on said flanges between a gear-engaged position in which the worm is engaged with the worm gear and a gear-disengaged position in which the worm is disengaged from the worm gear, and means to support the frame with the main shaft coaxial with the counterbalance shaft and drivingly connected thereto.

23. A door operator as in claim 22 in which said last-named means comprises a coupling for connecting the main shaft to the counterbalance shaft in both driving and supporting relationship so as to support the main shaft and the frame assembly on the counterbalance shaft, and a torque reaction connection between the frame and a fixed support so that motor driven rotation of the main shaft in the frame will drive the counterbalance shaft.

24. A door operator as in claim 23 in which the counterbalance drum shaft is a hollow shaft and which includes a coupling having an expansible end for insertion in such hollow shaft and expansion to fix the same therein, and a connection end for connection to the main shaft of the door operator, said coupling being constructed and arranged to support the main shaft in coaxiakl supported relation with the counterbalance drum shaft.

25. A door operator unit adapted to be mounted directly on the end of the counterbalance shaft of an overhead garage door which is counterbalanced by means including such a shaft and a lift cable attached to the door, comprising a compact unitary assembly including a frame having a main shaft journalled therein, a worm gear mounted on said shaft and drivingly connected thereto, a motor mounted on said frame, and a worm mounted on the shaft of such motor in driving relation with the worm gear on the main shaft, means for connecting the main shaft in coaxial end-to-end relation with the counterbalance shaft so as to support the unitary assembly by its said main shaft directly on the counterbalance shaft and thereby provide at least the primary support for such assembly, and stabilizing means including means for transmitting torque reaction from said unitary assembly to a fixed support.

26. A door operator as in claim 25 in which the counterbalance shaft is hollow and said connecting means comprises an expansible portion adapted to be inserted in the end of the hollow counterbalance shaft and to be expanded into driving and supporting relation therewith.

27. A door operator as in claim 25 with the addition of a supplemental supporting stay connected to the operator in axially spaced relation from said coupling and adapted to be connected to an overhead fixed support so as to supplement the cantilever support of the assembly from the counterbalance shaft.

28. A door operator as in claim 25 in which said reaction torque-transmitting means includes a motor control switch actuated in response to excess reaction torque and operable to interrupt the motor drive in response thereto.

29. A door operator for actuating an overhead garage door which is counterbalanced by means including a drum shaft having a drum thereon for a lift cable attached to the door, comprising a unitary assembly including a frame having a main shaft journalled therein, and a worm gear mounted on said shaft and drivingly connected thereto, a motor mounted on said frame, and a worm mounted on the shaft of such motor in driving relation with the worm gear on the main shaft, means for mounting said assembly with the main shaft in coaxial driving relation with the drum shaft of the door counterbalance means, and motor control means comprising a threaded extension on said main shaft, one or more travelling nuts mounted on said extension, a mounting plate extending axially of said shaft extension, switch means mounted on said plate and having actuating means in the path of the nut or nuts, and a stop bar removably mounted on said mounting plate and slidably engaged with radial faces on said nut or nuts so as to prevent their rotation and cause them to travel axially in response to rotation of said shaft extension for actuation of said switch means.

* * * * *

UNITED STATES PATENT AND TRADEMARK OFFICE

CERTIFICATE OF CORRECTION

PATENT NO. : 4,191,237

DATED : March 4, 1980

INVENTOR(S) : Clayton B. Voege

It is certified that error appears in the above-identified patent and that said Letters Patent are hereby corrected as shown below:

Column 11, line 5, change "crries" to --carries--; line 11, change "reaction" to --relation--; line 27, change "of" to --or--; line 30, change "of" to --to--; line 32, change "mtor" to --motor--; line 36, change "connected to" to --connected by--; line 46, change "mechanisnm" to --mechanism--.

Column 12, line 3, change "positins" to --positions--; line 28, (claim 1) change "haft" to --shaft--; line 31 (claim 1), change "is" to --in--; line 33 (claim 1), change "reactin" to --reaction--.

Column 13, line 34 (claim 13), change "of" to --on--.

Column 15, line 42 (claim 24), change "coaxiakl" to --coaxial--.

UNITED STATES PATENT AND TRADEMARK OFFICE

CERTIFICATE OF CORRECTION

PATENT NO. : 4,191,237

DATED : March 4, 1980

INVENTOR(S) : Clayton B. Voege

It is certified that error appears in the above—identified patent and that said Letters Patent is hereby corrected as shown below:

Column 10, line 7, change "upwards," to -- upward, --; line 28, change "life" to -- lift --; line 50, change "opening" second occurrence to -- openings --; line 55, "compressionspring" to -- compression spring --; line 57, delete "During down drive of the door, the travel in"; line 58, delete "the slots 446."; lines 59 and 60, change "operation" to -- operator --.

Signed and Sealed this

*Seventeenth* Day of *June 1980*

[SEAL]

*Attest:*

SIDNEY A. DIAMOND

*Attesting Officer*

*Commissioner of Patents and Trademarks*